US006070966A

United States Patent [19]

Desie et al.

[11] Patent Number: 6,070,966

[45] Date of Patent: Jun. 6, 2000

[54] METHOD FOR DIRECT ELECTROSTATIC PRINTING IN WHICH TONER PARTICLES ARE EXTRACTED DIRECTLY FROM A MAGNETIC BRUSH CARRYING A TWO-COMPONENT DEVELOPER WITH CONDUCTIVE CARRIER

[75] Inventors: Guido Desie, Herent; Raf Voets, Hever, both of Belgium

[73] Assignee: Agfa-Gevaert, Mortsel, Belgium

[21] Appl. No.: 08/926,542

[22] Filed: Sep. 10, 1997

Related U.S. Application Data

[60] Provisional application No. 60/032,350, Dec. 4, 1996.

[30] Foreign Application Priority Data

Oct. 10, 1996 [EP] European Pat. Off. ..... 96202815

[51] Int. Cl.[7] ..... B41J 2/04

[52] U.S. Cl. ..... 347/55

[58] Field of Search ..... 347/55, 120, 123, 347/111, 159, 141, 151, 127, 128, 17, 103, 154; 399/271, 290, 292, 293, 294, 295; 430/106.6, 108

[56] References Cited

U.S. PATENT DOCUMENTS

| | | | |
|---|---|---|---|
| 4,764,445 | 8/1988 | Miskinis et al. | 430/108 |
| 5,346,791 | 9/1994 | Ozawa et al. | 430/106.6 |
| 5,496,673 | 3/1996 | Saitoh et al. | 430/106.6 |

FOREIGN PATENT DOCUMENTS

| | | |
|---|---|---|
| 0675417 | 10/1995 | European Pat. Off. . |
| 858142 | 8/1994 | Japan . |

*Primary Examiner*—John Barlow
*Assistant Examiner*—Raquel Yvette Gordon
*Attorney, Agent, or Firm*—Baker Botts L.L.P.

[57] ABSTRACT

A method for direct electrostatic printing includes the steps of providing a magnetic brush carrying carrier particles and toner particles, the carrier particles having a specific volume resistivity of between $10^1$ Ω·cm and $10^9$ Ω·cm and a specific density lower than 5 g/cm$^3$, creating in an electrical field a flow of charged toner particles directly from the magnetic brush to a substrate, image wise modulating the flow of charged toner particles by a printhead structure having printing apertures and control electrodes, image wise depositing toner particles from the image wise modulated flow of charged toner particles on the substrate, and fixing the toner particles to the substrate.

8 Claims, 1 Drawing Sheet

METHOD FOR DIRECT ELECTROSTATIC PRINTING IN WHICH TONER PARTICLES ARE EXTRACTED DIRECTLY FROM A MAGNETIC BRUSH CARRYING A TWO-COMPONENT DEVELOPER WITH CONDUCTIVE CARRIER

The application claims the benefit of the U.S. Provisional Application No. 60/032,350 filed Dec. 4, 1996.

FIELD OF THE INVENTION

This invention relates to a developer and an apparatus for use in the process of electrostatic printing and more particularly in Direct Electrostatic Printing (DEP). In DEP, electrostatic printing is performed directly from a toner delivery means on a substrate by means of an electronically addressable printhead structure.

BACKGROUND OF THE INVENTION

In DEP (Direct Electrostatic Printing) the toner or developing material is deposited directly in an image-wise way on a receiving substrate, the latter not bearing any image-wise latent electrostatic image. In the case that the substrate is an intermediate endless flexible belt (e.g. aluminium, polyimide etc.), the image-wise deposited toner must be transferred onto another final substrate. If, however, the toner is deposited directly on the final receiving substrate, a possibility is fulfilled to create directly the image on the final receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means (this wording is throughout this document to indicate the means for delivering toner particles) and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. The printhead structure as described in U.S. Pat. No. 3,689,935 suffers from the fact that high speed printing at high printing quality is limited by clogging of some apertures. By implementing a large number of rows of printing apertures, the overall printing speed can, in theory, be enhanced, but in practice it is found that said printing speed is levelled to the amount of toner that can pass through the row of apertures having the smallest flux of toner particles, and banding with a frequency corresponding to the different rows of printing apertures can be easily observed.

The problem of obtaining a different printing density for different rows of printing apertures, i.e. banding, has been tackled in various ways. In U.S. Pat. No. 5,214,451 a printhead structure has been described consisting of different rows of apertures, each having a different shield electrode segment. During printing the voltage applied to the different shield electrode segments corresponding to the different rows of printing apertures is changed, so that these apertures that are located at a larger distance from the toner application module are tuned for a larger electrostatic propulsion field from said toner application module towards said back electrode structure, resulting in enhanced density profiles with less banding. The toner flux can be slightly enhanced for the "low density" rows of printing apertures, said toner flux must be greatly reduced for the "high density" rows of printing apertures. As a result the overall printing speed is reduced if enhanced image quality regarding white banding is preferred.

In U.S. Pat. No. 5,040,004 a moving belt is introduced as toner application module, said moving belt sliding over an accurately positioned shoe that is placed at close distance from said printhead structure. With this design the distance, and as a consequence also the propulsion field, can be finely tuned to be equal for all rows of printing apertures. This, however, causes very accurate and expensive means to be used in order to fabricate a toner application module according to said invention. Moreover, sliding contact, is never beneficial for excellent long term stability and reliability.

In U.S. Pat. No. 5,327,169, EP-A-675 417, JP-A-60 263 962 and JP-A-08 058142 a magnetic brush using a two-component development system has been described as toner application module in a DEP device. Also in DEP devices using a magnetic brush as toner delivery means, the distance between the magnetic brush and different sets of rows of printing apertures is different. Due to this fact also the propulsion field wherein the toner particles are jetted to the substrate is different for different sets of rows of printing apertures and thus the problem of banding still exists.

According to EP-A-731 394, in a DEP device using a magnetic brush as toner delivery means, the curvature of said magnetic brush is adapted to the extension in said printhead structure, so that banding can be minimised. This concept, however, leads to the introduction of more expensive magnetic brush devices, making the DEP device considerably more complicated, weighty and expensive.

In DE-A-195 34 705 the toner application device and printhead structure has been implemented twice for each colour, so that the problem of white banding can be reduced, but again at the expense of complexity and cost of the printing device.

In CA-A-2 135 705 a toner application device similar to a video cassette is used. A flexible band carrying toner particles is moved in a direction orthogonal to the rows of printing apertures, yielding a constant distance, and propulsion field, for every row of printing apertures. The main drawback of this system, however, is the consumption of toner particles from one side of a row of printing apertures to the other side, making it not possible to print with an equal density profile over the complete width of the receiver material.

In EP-A-587 366 the printhead structure is bent over the roller-shaped toner applicator so that for every row of printing apertures the distance towards the toner application module (and thus the propulsion field) is rather constant. The main drawback of this device is again the frictional contact over toner particles that greatly reduces the overall printing quality and long term stability.

When the cylindrical toner delivery means, from which the toner particles are extracted and brought in the neighbourhood of a printhead structure, is not a perfectly centred cylinder, white banding orthogonal to the printing direction can be observed. This banding can be attributed to fluctuations in distance between the surface of the toner delivery means and the printhead structure. In EP-A-736 822 it is described to minimise said banding by adjusting the rotation speed of the cylindrical toner delivery means to the speed by which the receiving substrate is moved. In order to keep the printing speed high it is necessary that the cylindrical toner delivery means is rotated at very high speed, which can bring problems with wear, mechanical stability, etc.

There is thus still a need for a DEP device yielding images of high density without white banding in a reliable, long-lasting way and without the need for mechanically complex means to diminish the possibility of banding.

OBJECTS OF THE INVENTION

It is an object of the invention to provide an improved Direct Electrostatic Printing (DEP) device, printing images with a high density resolution and with a high spatial resolution with reduced and even eliminated banding.

It is a further object of the invention to provide a DEP device combining high spatial resolution with good long term stability and reliability.

It is another object of the invention to provide a DEP device printing images without banding at a high printing speed.

Further objects and advantages of the invention will become clear from the description hereinafter.

The above objects are realised by providing a method for Direct Electrostatic Printing (DEP) comprising the steps of:

creating a flow of charged toner particles in an electrical field from a magnetic brush to a substrate, image wise modulating said flow of charged toner particles by a printhead structure comprising printing apertures and control electrodes, image wise depositing toner particles, from said image wise modulated flow of charged toner particles, on said substrate and fixing said toner particles to said substrate, characterised in that said flow of charged toner particles is created directly from said magnetic brush, carrying carrier particles and toner particles and said carrier particles have a specific volume resistivity between $10^1$ Ω·cm and $10^9$ Ω·cm and said carrier particles have a specific density lower than 5 g/cm$^3$.

In a preferred embodiment said resistivity is between $10^2$ and $10^6$ Ω·cm.

DETAILED DESCRIPTION OF THE INVENTION

Figure 1:
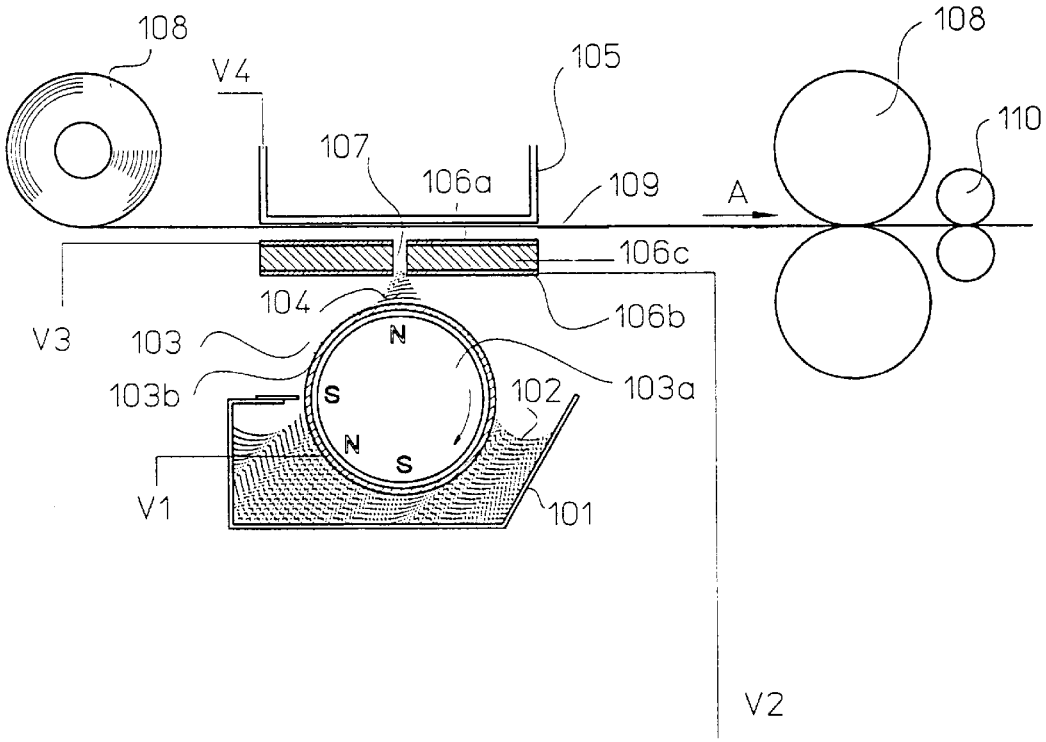
FIG. 1 is a schematic illustration of a possible embodiment of a DEP device according to the present invention.

In the literature many devices have been described that operate according to the principles of DEP (Direct Electrographic Printing). All these devices are able to perform grey scale printing either by voltage modulation or by time modulation of the voltages applied to the control electrodes. High quality images, however, can only be obtained if the starting toner flux through each individual printing aperture is identical. By proper voltage or time modulation, images with an excellent grey scale are then possible.

We have found that a benefit regarding white banding in images with constant density profiles can be obtained without the introduction of additional expensive hardware or control means as described in e.g. U.S. Pat. No. 5,040,004, U.S. Pat. No. 5,214,451, CA-A-2 135 705, DE-A-195 34 705 or EP-A-731 394. When in a conventional DEP device as described in U.S. Pat. No. 5,327,169 and EP-A-675 417, wherein toner particles are directly extracted from a magnetic brush, carrying magnetic carrier particles and toner particles, carrier particles with a specific volume electrical resistance between $10^1$ Ω·cm and $10^9$ Ω·cm, preferably between $10^2$ and $10^6$ Ω·cm, more preferably between $10^2$ and $10^4$ Ω·cm, are used, the problem of white banding can be diminished and even avoided. The beneficial effect of using carrier particles with specific volume resistance as defined above can be observed with any magnetic brush, e.g., it is observed when using a magnetic brush with rotating magnetic core and stationary sleeve, a magnetic brush with rotating magnetic core and rotating sleeve, and with a magnetic brush with stationary magnetic core and rotating sleeve. With the latter type of magnetic brush, the beneficial effect of using carrier particles with a specific volume electrical resistance between $10^1$ Ω·cm and $10^9$ Ω·cm, preferably between $10^2$ and $10^6$ Ω·cm, more preferably between $10^2$ and $10^4$ Ω·cm, is quite pronounced.

It is believed, without being bound by any theory, that the mechanism of operation of said invention is as follows: the voltage that is applied to the sleeve of said magnetic brush is partly conducted to the shield electrode structure of said printhead structure if carrier particles are used with a minimal conducting power (specific electrical resistance not too high). Since a fixed magnetic core/rotating sleeve magnetic brush carries developer hairs of differing length to the shield electrode of said printhead structure, the value of said voltage, comprising a DC and/or AC component, is partly extended to said "last" developer particle making contact with said printhead structure. For that reason it can be regarded as if a carrier particle bearing charged toner particles, is brought at nearly zero distance from said printhead structure, and is electrically excited with a nearly equal force as carrier particles that stay in contact with the sleeve of said magnetic brush. From said carrier particles at nearly zero distance, toner particles can be extracted and propelled through said apertures to the receiving member by the attractive voltage applied by the back electrode placed behind said receptive member.

In JP-A-08 58142, the use of very conductive carrier particles, e.g., metal powder, metal oxide powder, pure ferrites, etc is disclosed. It was found that the use of such highly conductive carrier particles, having a specific resistivity lower than the lowest value specified in this invention, could occasionally lead to the formation of sparks between the printhead structure and the magnetic brush. It is believed that when an hair of the magnetic brush becomes depleted of insulating toner particles, the conductivity of it is so high as to cause sparking. Therefore it is preferred that the carrier particles according to the present invention are coated with a insulating resin or are composite carriers, comprising magnetic particles in a resinous binder matrix. The conductivity (or resistivity) of such carrier particles can be fine tuned to avoid sparking by adjusting the specific resistivity to a value equal to or higher than $10^1$ Ω·cm, preferably to a value equal to or higher than $10^2$ Ω·cm. Moreover by using carrier particles coated with a insulating resin or by using composite carriers the specific resistivity can be fine tuned to the toner particles used (e.g. to the insulating resin used in the toner particles), to the desired charge of the toner particles, etc. The carrier particles, described in JP-A-08 58142, exhibit high specific density (>5 g/cm$^3$ and even larger than 7 g/cm$^3$). Therefore these particles become less well suited in fast running DEP printers, because, due to the mechanical inertia and thus slow mixing capacity, the amount of toner particles, that can be brought in the vicinity of the printing apertures of a DEP device by the magnetic brush, is limited. Therefore it is preferred that the carrier particles of the present invention show a specific density lower than 5 g/cm$^3$. More preferably composite carriers, comprising magnetic particles in a resinous binder matrix are used, in the present invention. Such carrier particles have generally a specific density lower than 5 g/cm$^3$ and the surface of them is essentially (for more than 80%) made up by said resinous binder matrix or resinous coating. This presence of an organic resin at the surface of the carrier particles makes it possible to fine tune the tribo-electric interaction of the carrier particles and the toner particles by adjusting the tribo-electric properties of both the resin used in the carrier particles and the resin used in the toner. Very suitable composite carriers, from which the resistivity can be brought within the boundaries of the present invention, have been described in EP-B-289 663, U.S. Pat. No. 5,336,580, etc. The specific volume resistivity of carrier particles can be adjusted to bring them within the boundaries of the present invention by e.g. using ferrite magnetic particles, including between 1 to 5% of lanthanum in the preparation of composite carrier particles. Such carrier particles, useful in the present invention, have been disclosed in e.g. U.S. Pat. No. 4,764,445. Also the incorporation of conductive material (particles) in the surface of the carrier particles can be used to adjust the specific resistance of resin coated or composite carrier particles according to this invention. Said conductive material can be, e.g., carbon black, tin oxide, titanium oxide, silicon carbide, etc. Carrier particles comprising conductive particles at the surface and useful in the present invention, have be described in, e.g., U.S. Pat. No. 5,346,791 and U.S. Pat. No. 5,496,673.

When resin coated carriers are used, the specific volume resistivity can be adjusted to the range according to the present invention by adjusting the thickness of the coating.

Organic resins useful in carrier particles according to the present invention, can be of any type known in the art and are chosen in combination with the resins used in the toner particles such has to give the toner particles, that come in to tribo-electric contact with said carrier particles, the desired sign and amount of the tribo-electric charge. Suitable resins, for use in carrier particles according to this invention, are, e.g., polyester resins, acrylic resins, fluorinated resins, etc.

The specific resistivity of the carrier particles is measured as follows (measurement A)

In a cylindrical measuring cell, made of a cylindrical plastic housing and having a bottom in conductive material (stainless steel) with surface S of 4 cm$^2$ is packed with carrier particles for an height of 0.4 cm (h). On the carrier particles a plunger, made of conductive material (stainless steel), is placed on the carrier particles and loaded with 1 kg weight. An electric circuit is built between the plunger and the bottom of the measuring cell being in contact with the carrier particles. A DC voltage of 100 V is applied over the electric circuit and the current (I) flowing trough the circuit, measured in $10^{-3}$ A. From this measurement the specific resistivity (ρ) is calculated. When measuring particle with rather low specific resistivity, the DC voltage, is lowered.

Description of a DEP device

A non limitative example of a device for implementing a DEP method according to the present invention comprises (FIG. 1):

(i) a toner delivery means (101), i.e. means for delivering toner particles, comprising a container for developer (102), being a multi component developer, with toner particles and carrier particles according to the present invention, and a magnetic brush assembly (103) with a core (103*a*) and a sleeve (103*b*), this magnetic brush assembly forming a developer cloud (104)

(ii) a back electrode (105)

(iii) a printhead structure (106), made from a plastic insulating film (106*c*), coated on both sides with a metallic film. The printhead structure (106) comprises one continuous electrode surface, hereinafter called "shield electrode" (106*b*) facing in the shown embodiment the toner delivering means and a complex addressable electrode structure, hereinafter called "control electrode" (106*a*) around printing apertures (107), facing, in the shown embodiment, the toner receiving member in said DEP device. The location and/or form of the shield electrode (106*b*) and the control electrode (106*a*) can, in other embodiments of a device for a DEP method, be different from the location shown in FIG. 1.

(iv) conveyer means (108) to convey an image receptive member (109) for said toner between said printhead structure and said back electrode in the direction indicated by arrow A.

(v) means for fixing (110) said toner onto said image receptive member.

The back electrode (105) of this DEP device can also be made to co-operate with the printhead structure, said back electrode being constructed from different styli or wires that are galvanically insulated and connected to a voltage source as disclosed in e.g. U.S. Pat. Nos. 4,568,955 and 4,733,256. The back electrode, co-operating with the printhead structure, can also comprise one or more flexible PCB's (Printed Circuit Board).

Between said printhead structure (106) and the magnetic brush assembly (103) as well as between the control electrode around the printing apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, shown in FIG. 1. voltage V1 is applied to the sleeve (103*b*) of the magnetic brush assembly 103, voltage V2 to the shield electrode 106*b*, voltages V30 up to V3n for the control electrode (106*a*). The value of V3 is selected, according to the modulation of the image forming signals, between the values V30 and V3n, on a time-basis or grey-level basis. Voltage V4 is applied to the back electrode behind the toner receiving member. In other embodiments of the present invention multiple voltages V20 to V2n and/or V40 to V4n can be used.

The magnetic brush assembly (103) used in a DEP device according to an embodiment of the present invention can be either of the type with stationary core and rotating sleeve or of the type with rotating core and rotating or stationary sleeve.

The carrier particles, having a specific volume resistance according to the present invention, can be soft magnetic particles as well as hard magnetic particles. Soft and hard magnetic particles as described in the EP-A 675 417, that is included herein by reference, can be used in the present invention. Any kind of two-component toner particles, black, coloured or colourless, can be used in a DEP device according to the present invention. It is preferred to use toner particles as disclosed in EP-A 715 218, that is incorporated by reference.

A DEP device making use of the above mentioned toner (marking) particles can be addressed in a way that enables it to give black and white. It can thus be operated in a "binary way", useful for black and white text and graphics and useful for classical bi-level halftoning to render continuous tone images.

A DEP device according to the present invention is especially suited for rendering an image with a plurality of grey levels. Grey level printing can be controlled by either an amplitude modulation of the voltage V3 applied on the control electrode 106*a* or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution, obtained by the small-diameter printing apertures (107), and of the multiple grey level capabilities typical for DEP, opens the way for multilevel halftoning techniques, such as e.g. described in the EP-A-634 862. This enables the DEP device, according to the present invention, to render high quality images.

If the conductivity of the developer used in a DEP device according to the present invention is not sufficient to level all distance fluctuations from the sleeve of said magnetic brush, then additional correcting components can be incorporated in said DEP device as described already in the literature, making the device more complicated and expensive but yielding images with excellent quality. Especially suitable in such instances is a modification to the printhead structure as described in U.S. Pat. No. 3,689,935 so that on the shield electrode side of said printhead structure facing the toner application module not only at least a row of printing apertures is available but also a row of thin film transistors. Such thin film transistors are well known in the art of solid-state detectors for radiology applications. Interesting descriptions have been given in the literature: see e.g. SPIE Vol. 1651 Medical Imaging VI: Instrumentation (1992) pages 134–141.

Any thin film material suitable for sensing a distance-dependent electrical field can be used to correct said fluctuation in distance. Therefore the change in electrical field is measured. Since it corresponds to the change in distance, an additional controlling means can take into account this distance fluctuation and correct for it by a voltage or time modulated correction on either the control electrode potential, shield electrode segment potential or applicator segment potential. It is clear for those skilled in the art that any field effect measuring device can also be used in DEP devices that operate with other applicator means as the magnetic brush described in this invention. Other suitable examples are applicator devices with charged toner conveyors, non-magnetic mono-component application devices, magnetic mono-component application devices, polymeric hairs containing brush devices, etc.

EXAMPLES

The DEP device

A printhead structure (106) was made from a polyimide film of 50 μm thickness, double sided coated with a 17.5 μm thick copper film. The printhead structure (106) had four rows of printing apertures. On the back side of the printhead structure, facing the receiving member substrate, a square shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures had an aperture diameter of 100 μm. The total width of the square shaped copper control electrodes was 250 μm, their internal aperture width was also 100 μm. The width of the aperture in the common shield electrode was 400 μm. Said printhead structure was fabricated in the following way. First of all the control electrode pattern was etched by conventional copper etching techniques. Then the shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70, commercially available from Kontakt Chemie, was applied over the control electrode side of said printhead structure.

The toner delivery means (101) was a stationary core/rotating sleeve type magnetic brush comprising two mixing rods and one metering roller. One rod was used to transport the developer through the unit, the other one to mix toner with developer.

The magnetic brush assembly (103) was constituted of the so called magnetic roller, which in this case contained inside the roller assembly a stationary magnetic core (103*a*), showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve (103*b*) was made of stainless steel roughened with a fine grain to assist in transport (<50 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements (mixing rods and metering rod) rotating at such a speed as to conform to a good internal transport within the development unit. The magnetic brush assembly (103) was connected to an AC power supply with a square wave oscillating field of 600 V at a frequency of 3.0 kHz with 0 V DC-offset.

The toner used for the experiment had the following composition: 97 parts of a co-polyester resin of fumaric acid and propoxylated bisphenol A, having an acid value of 18 and volume resistivity of $5.1\times10^{16}$ Ω·cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$—was added in a quantity of 0.5% with respect to the binder.

After cooling, the solidified mass was pulverised and milled using an ALPINE Fliessbettgegenstrahlmühle type 100AFG (trade name) and further classified using an ALPINE multiplex zig-zag classifier type 100 MZR (trade name). The resulting particle size distribution of the separated toner, measured by Coulter Counter model Multisizer (trade name), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

An electrostatographic developer was prepared by mixing said mixture of toner particles and colloidal silica in a 4% ratio (wt/wt) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to a method as described in the above mentioned EP-A-675 417, giving q=−7.1 fC, q as defined in said application.

The distance 1 between the front side of the printhead structure (106) and the sleeve of the magnetic brush assembly (103), was set at 450 μm. The distance between the back electrode (105) and the back side of the printhead structure (106) (i.e. control electrodes 106*a*) was set to 500 μm and the paper travelled at 1 cm/sec. To the individual control electrodes an (image-wise) voltage V3 between 0 V and −300 V was applied. The back electrode (105) was connected to a high voltage power supply of +1 500 V. To the sleeve of the magnetic brush and the common shield electrode an AC voltage of 600 V at 3.0 kHz was applied, without DC offset.

Example 1

A printing device and toner as describe above were used. The carrier particles were a magnetite carrier, coated with 2% by weight with respect to the total weight of the carrier of a silicone-resin coating, said coating comprising for 4% by weight, with respect to the total coating, of an aminocomponent. The average particle diameter was 67 μm. The specific volume resistivity of said carrier particles, as measured according to measurement A, was 1.8 $10^6$ Ω·cm. The specific density was 2.75 $g/cm^3$.

Example 2

Example 1 was repeated, except for the carrier particles. A macroscopic "soft" ferrite carrier consisting of a MgZn-ferrite with average particle size 88 μm, coated with 1.6% by weight, with respect to the total weight of the carrier, of a polystyreneacrylate coating, was used. The specific volume resistivity of said carrier particles, as measured according to measurement A, was 8 $10^5$ Ω·cm. The specific density was 2.87 $g/cm^3$.

Example 3

Example 1 was repeated, except for the carrier particles. A commercial silicone coated carrier, sold under number PF96-3035 by Powdertech Corp, Valparaiso, In, USA, was used. The average particle diameter was 55 μm. The specific volume resistivity of said carrier particles, as measured according to measurement A, was 5.5 $10^9$ Ω·cm. The specific density was 2.67 $g/cm^3$.

Example 4

Example 1 was repeated, except for the carrier particles. A macroscopic "soft" ferrite carrier consisting of a MgZn-ferrite, coated with 2% by weight with respect to the total weight of the carrier of a silicone-resin coating, said coating comprising for 4% by weight, with respect to the total coating, of an aminocomponent. The average particle diameter was 54 μm. The specific volume resistivity of said carrier particles, as measured according to measurement A, was 1.1 $10^{14}$ Ω·cm. The specific density was 2.94 $g/cm^3$.

Example 5

Example 1 was repeated, except for the carrier particles. A stainless steel carrier, with diameter of about 300 μm was used. These carrier particles are available under trade name METABRASIVE S70 from Metabrasive Ltd, Capponfield Works, WEST MIDLANDS, UK. The specific resistivity, measured at 10 V DC, was 1.4 $10^3$ Ω·cm and the specific density 7.6 $g/cm^3$. While printing, the DEP device was adapted to the use of the large carrier particles by setting the distance of the doctor blade to 800 μm instead of to 400 μm.

Grey scale images with 16 time-modulated levels were printed with different developers as tabulated in table 1. The image homogeneity was visually judged for white-banding artefacts on a scale from 1 to 5, wherein 5 means unacceptable and 1 very good. At the same time the occurrence of carrier loss was also judged.

The results are tabulated in table 1.

TABLE 1

| Sample | Resistivity in Ω · cm | Specific density $g/cm^3$ | Carrier loss | Print quality |
|---|---|---|---|---|
| E1 | 1,8 $10^6$ | 2.75 | NO | 2 |
| E2 | 8 $10^5$ | 2.87 | NO | 1 |
| E3 | 5.5 $10^9$ | 2.67 | NO | 4 |
| E4 | 1,1 $10^{14}$ | 2.94 | NO | 5 |
| E5 | 1,4 $10^3$ | 7.6 | YES | 1 |

From table 1 it is clear that the carrier particles according to the present invention can offer an excellent solution to the problem of white banding in DEP devices, while avoiding carrier loss.

What is claimed is:

1. In a method for direct electrostatic printing, wherein charged toner particles are caused to flow in an electric field from a magnetic brush to a substrate, wherein the flow of toner particles is image wise modulated by a printhead structure having printing apertures and control electrodes, wherein said toner is fixed to said substrate and wherein said magnetic brush is provided with magnetic carrier particles and said charged toner particles, the improvement wherein said carrier particles are provided to said magnetic brush with a specific volume resistivity of between $10^1$ Ω·cm and $10^9$ Ω·cm and a specific density lower than 5 gm/cm$^3$.

2. The improvement specified in claim 1, wherein said carrier particles are provided with a specific volume resistivity of between $10^2$ Ω·cm and $10^6$ Ω·cm.

3. The improvement specified in claim 2 wherein composite carrier particles are provided.

4. The improvement specified in claim 2 wherein said carrier particles are provided to a magnetic brush having a rotating magnetic core and a stationary sleeve.

5. The improvement specified in claim 1 wherein said carrier particles are provided with a specific volume resistivity of between $10^2$ Ω·cm and $10^4$ Ω·cm.

6. The improvement specified in claim 1 wherein composite carrier particles are provided.

7. The improvement specified in claim 1 wherein carrier particles are provided having superficial conductive particles.

8. The improvement specified in claim 1 wherein said carrier particles are provided to a magnetic brush having a rotating magnetic core and a stationary sleeve.

* * * * *